US005468061A

United States Patent [19]

Fries et al.

[11] Patent Number: 5,468,061

[45] Date of Patent: Nov. 21, 1995

[54] CABINET BODY STRUCTURE AND ARTICULATED JOINT MEANS FOR USE WITH THE STRUCTURE

[75] Inventors: Bror Fries, Hishult, Sweden; Yusho Nakamoto, Hiroshima, Japan

[73] Assignee: A/S Grorud Jernvarefabrik, Oslo, Norway

[21] Appl. No.: 211,976

[22] Filed: Jun. 21, 1994

[30] Foreign Application Priority Data

Oct. 23, 1991 [NO] Norway ..... 914165

[51] Int. Cl.[6] ..... A47B 43/00; E05D 11/10

[52] U.S. Cl. ..... 312/258; 16/297

[58] Field of Search ..... 16/335, 355, 356, 16/374, 297, 296; 52/71, 64; 312/258, 262, 263, 265.5

[56] References Cited

U.S. PATENT DOCUMENTS

| | | | |
|---|---|---|---|
| 926,367 | 6/1909 | Tomison . | |
| 1,011,584 | 12/1911 | Connolly . | |
| 2,132,266 | 10/1938 | Lefevre . | |
| 2,360,452 | 10/1944 | Stone . | |
| 2,725,590 | 12/1955 | Ziegler . | |
| 3,829,190 | 8/1974 | Jackson . | |
| 4,247,965 | 2/1981 | Lautenschlager | 16/296 X |
| 4,654,930 | 4/1987 | Lautenschlager, Jr. et al. | 16/296 X |
| 4,716,622 | 1/1988 | DeBruyn | 16/297 |
| 4,894,884 | 1/1990 | Lautenschlager, Jr. | 16/296 X |
| 4,914,782 | 4/1990 | Rupprechter . | |
| 5,022,117 | 6/1991 | Lautenschlager et al. | 16/296 X |
| 5,027,474 | 7/1991 | Bowers | 16/297 |
| 5,029,362 | 7/1991 | Prodan | 16/296 X |

FOREIGN PATENT DOCUMENTS

| | | | |
|---|---|---|---|
| 52239 | 5/1976 | Finland . | |
| 639816 | 6/1928 | France | 312/258 |
| 2806735 | 8/1979 | Germany . | |
| 165933 | 1/1991 | Norway . | |
| 421439 | 12/1981 | Sweden . | |
| 911318 | 11/1962 | United Kingdom | 312/258 |

*Primary Examiner*—Kenneth J. Dorner
*Assistant Examiner*—Robert J. Sandy
*Attorney, Agent, or Firm*—Townsend and Townsend and Crew

[57] ABSTRACT

The invention relates to a method for storing and mounting the body for a cabinet, furniture or the like, consisting of two sides (2, 3), top (1) and base (4), where adjacent end sections of said sides, top and base are provided with articulation devices (6, 7, 8, 11) to join the parts together. Said sides, top and base are arranged in transport or storage state such that said top and one of the sides (1, 2) lie parallel with said base and the other side (3, 4). The body is mounted by moving said two sides (2, 3), together with the top (1) and base (4), in mutually parallel relationship like a parallellogram until said two sides (2, 3) are vertical, whereafter at least one of the two sets of articulation devices (6, 8) situated diagonally in the body is releasably locked into position. The means for forming an articulated joint between adjacent end sections of the structural parts, e.g., sides, top and base of a body for a cabinet or the like, comprises a cup-shaped body (6, 7, 8) which is hinge-connected to an approximately L-shaped (8'), U-shaped (6') or stepped straight arm. The arm may be equipped with a rotatable tension pin adapted for engagement with a recess in the member.

15 Claims, 4 Drawing Sheets

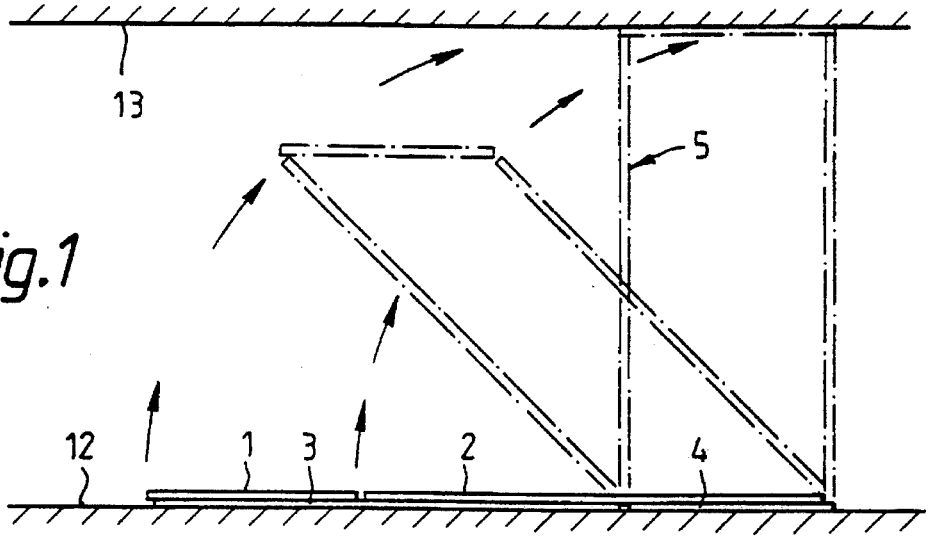
Fig.1
Fig.2
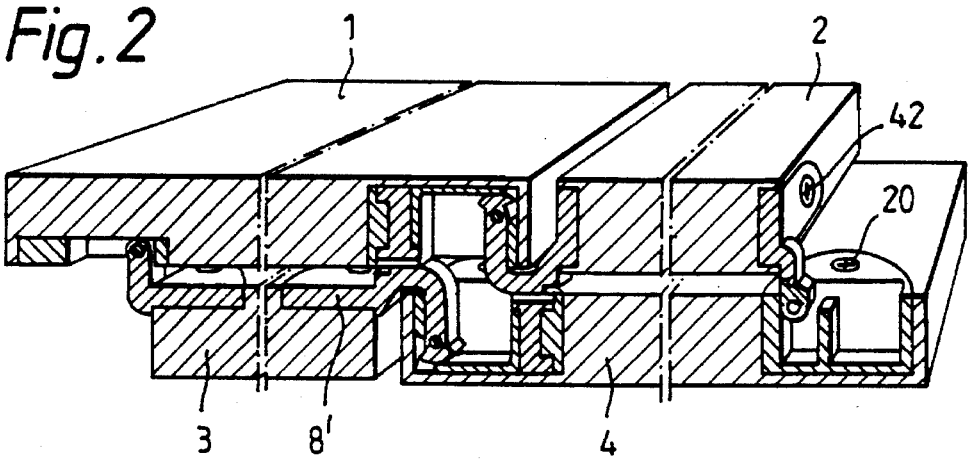
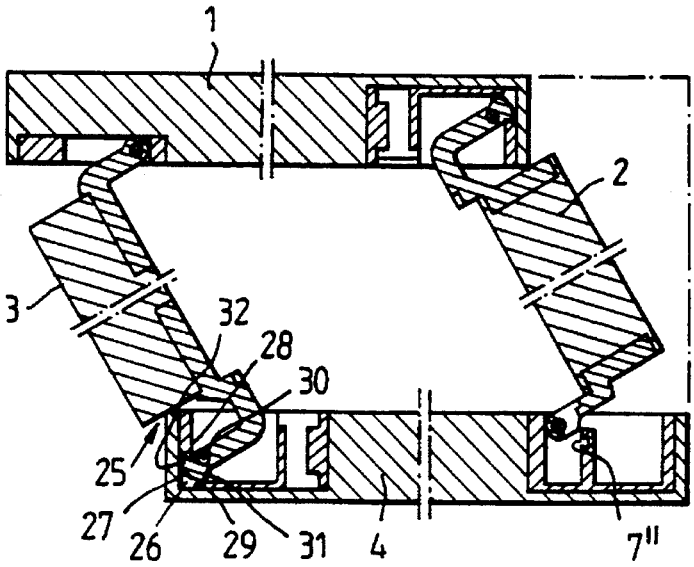
Fig.3

Fig. 9
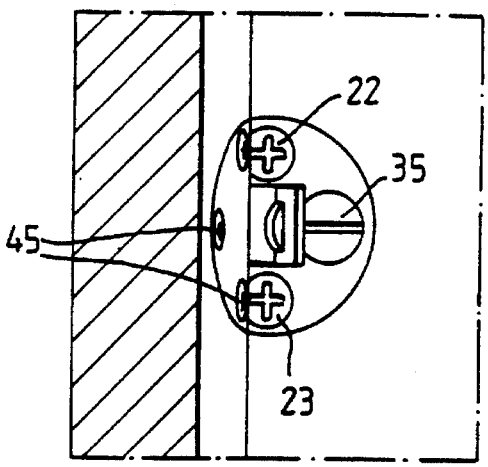
Fig. 11
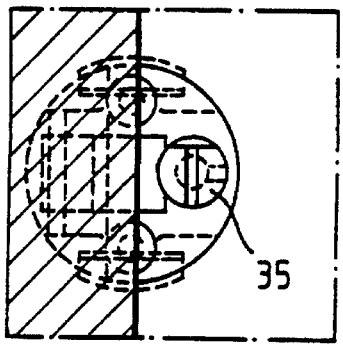
Fig. 10
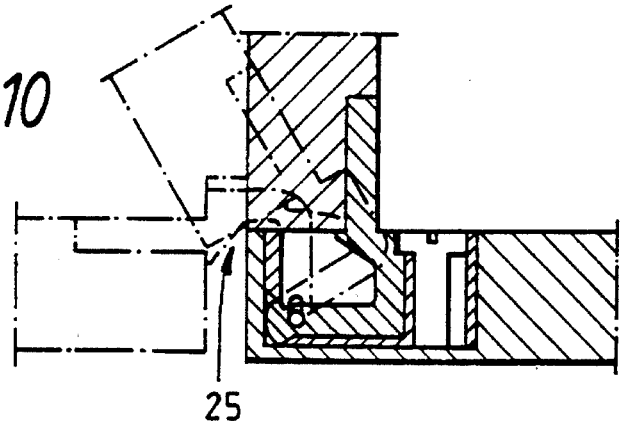
Fig 12 (a)
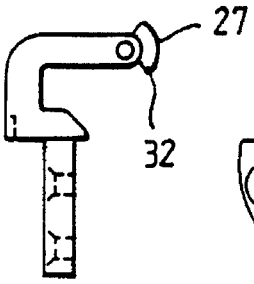
Fig 12 (c)
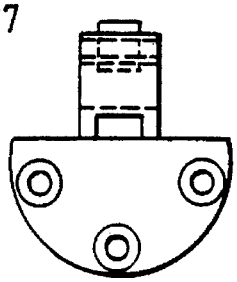
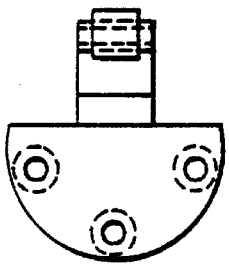
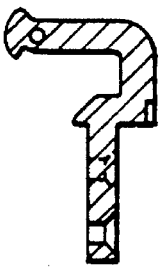
Fig 12 (b)
Fig 12 (d)

CABINET BODY STRUCTURE AND ARTICULATED JOINT MEANS FOR USE WITH THE STRUCTURE

BACKGROUND OF THE INVENTION

The present invention relates to a cabinet body structure and articulated joint means for forming an articulated joint between adjacent end sections of structural parts of the body, e.g., its sides, top and base.

Cabinets, furniture or the like almost always consist of two sides plus a top and base which form a rectangle. These four units are connected together at the corners by means of methods such as miterings, edge joining or dovetailing. The latter method has all but disappeared from commercial products due to high costs and inefficient production. The mitering alternative is realistic only when a definitive jointing takes place at the factory.

Edge joining is therefore the totally dominant method of section joining today. If the joining is done at a factory, an enormous amount of space is required for warehousing and distribution, which thus become very expensive. Therefore, a significant share of the manufacturing is done according to the so-called "knock-down" system, i.e., the delivered goods consist of finished, surface-treated separate sections that are assembled by the customer. In order for such a system to function, detailed labeling and description must accompany the delivery. If the customer has had no experience with such mounting, which is often the case, the customer will often have problems with the assembly and will use a great deal of time before the right parts are correctly assembled and the structure has the final form that is intended.

There are a number of different systems for joining the parts, e.g., screws with visible decorative heads or tension devices and lockable hooks. All known solutions, however, have the common feature that the four sides of which the structure consists are disconnected units.

SUMMARY OF THE INVENTION

According to the invention, these disadvantages have been eliminated by arranging to have the sides, top and base assembled at the factory.

The method according to the present invention is characterized in that adjacent end sections of the sides, top and base are provided with articulation devices to join the parts together, that said sides, top and base in their transport or storage state are arranged such that said top and one of the sides lie parallel with said bottom and the other side, and that the body is mounted by moving said two sides, together with the top and base, in mutually parallel relationship like a parallellogram until said two sides are vertical, whereafter at least one of the two sets of articulation devices situated diagonally in the body is releasably locked into position.

To attain further rigidity in the body, it will be expedient for all of the articulation devices to be locked into position. The body should be provided with a total of at least four articulation devices.

The means mentioned in the Introduction for forming an articulated joint between adjacent end sections of structural parts is characterized according to the Invention by a cup-shaped body hinge-connected to an approximately L-shaped, U-shaped or stepped straight arm.

According to additional embodiment forms of the device, the approximately L-shaped or stepped arm is equipped with a rotatable fixation pin adapted for engagement with a ledge in said member. Said arm may be hinged to the cup-shaped body at the uppermost open section thereof.

According to a variation of the device, said approximately L- or U-shaped arm may be equipped with a ledge adapted for engagement with a fixation pin rotatably mounted in said member. Said arm will preferably be rotatably hinged to the cup-shaped body near the bottom thereof. The ends of the arm's rotating shaft will each move within an oblong bearing slot in the cup-shaped body during the movement of the arm between its outer positions.

The oblong bearing slot, in a first embodiment form, has straight sides and rounded ends, where its width corresponds to the diameter of the rotating shaft.

In a second embodiment the oblong bearing slot has the contour of a peanut shell, wherein the greatest width of the bearing slot corresponds to the diameter of the rotating shaft, and the narrowest width is slightly smaller than the diameter of the rotating shaft, so that a snap function is achieved. The fixation pin, in this case, is configured such that on its rotation, as it bears against said ledge, it gradually brings the arm's rotating shaft down from its upper part of the bearing slot via the part of the slot having narrower width, and to the lower part.

According to the first embodiment of the bearing slot, the arm is extended past the rotating shaft with a first hook-like portion which engages with the upper edge of an opening in the wall of the cup-shaped body and which, on rotation of the arm into the cup-shaped body, causes the rotating shaft to move from an upper position in the bearing slot to a lower position therein, and a second hook-like portion that engages with a lower edge of said opening and, on rotation of the arm out of the cup-shaped body, causes the rotating shaft to move from the lower position to the upper position in the bearing slot.

The cup-shaped body is adapted for fixed insertion in a recess or bore in said sides, top or base by the body being provided with slots that sectorize the circumference of the body, the outside of said sector adjacent to the respective slot being provided with grooves, and the slot having a conical hole for cooperation with a screw or pin which, by its rotation, causes expansion of the slot and engagement between the wall of the recess/bore and said grooves.

The invention will now be described in more detail with reference to the accompanying drawings.

BRIEF DESCRIPTION OF THE DRAWINGS

FIG. 1 illustrates the principle for the structure according to the invention.

FIGS. 2, 3 and 4 illustrate the structure and the articulated joints means according to the present invention in further detail.

FIG. 9 shows the view IX—IX in FIG. 6.

FIG. 10 a combination of FIGS. 5, 6 and 7.

FIG. 11 shows the view XI—XI In FIG. 7.

FIG. 12 illustrates an approximately L-shaped rotating arm in the articulated joint according to FIGS. 5–7 and 10, seen from the side in FIG. 12*a*, from a front side (FIG. 12*b*) and from a rear side (FIG. 12*c*), as well as in section (FIG. 12*d*).

DESCRIPTION OF PREFERRED EMBODIMENTS

Figure 4:
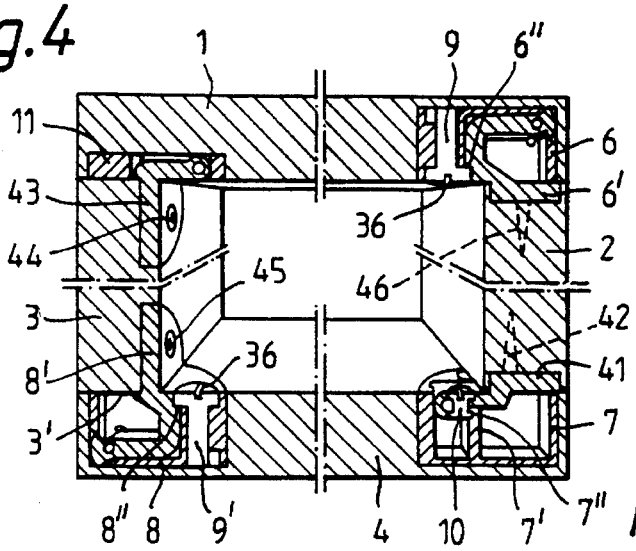
Figure 6:
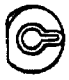
FIGS. 5, 6 and 7 illustrate an articulated joint, according to the invention, in various functional positions, with FIG. 10 showing a composite of FIGS. 5, 6 and 7.
Figure 5:
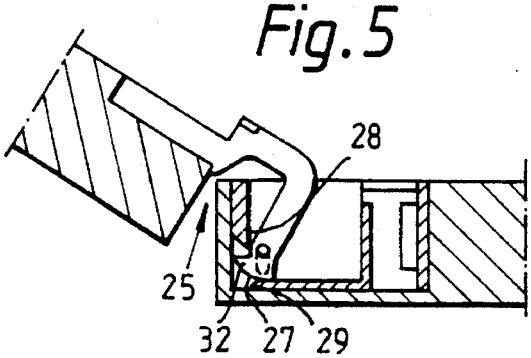
Figure 5:
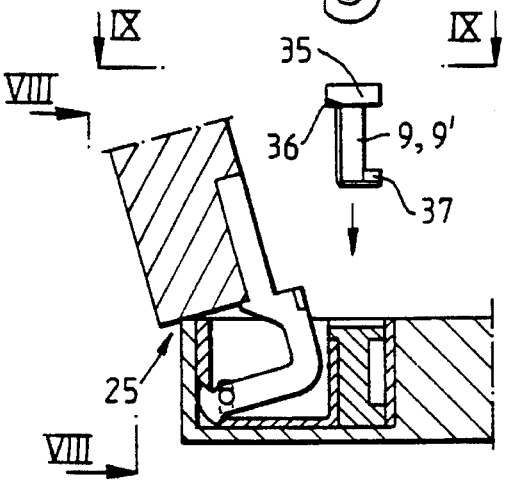
Figure 7:
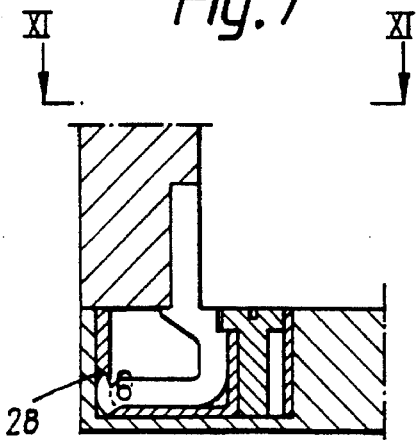
Figure 8:
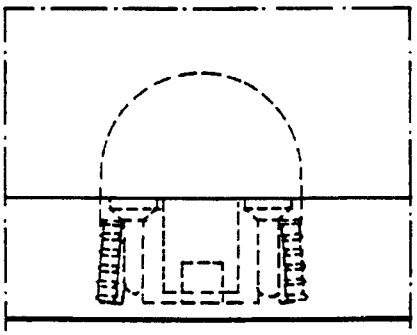
FIG. 8 shows the view VIII—VIII in FIG. 6.

In FIGS. 1–4 are shown the basic principles of the present invention, i.e., a permanent corner jointing of four sides which, from a flat package, such as is shown in FIGS. 1 and 2, may be raised up and locked into their right-angled, rectangular functional position. When the customer receives the body for, e.g., a cabinet, said body will be packed flat, as indicated in FIG. 1; i.e., it will consist of a top 1, a first side 2, a second side 3 and a base 4. When the customer has removed the wrapping around the package, he needs only to lift diagonally the top, with the sides connected thereto, into the functional position as indicated with reference numeral 5. As is shown in more detail in, among others, FIG. 4, the respective articulated joints 6, 7 and 8 may be provided with locking or fixation means 9, 9' and 10, respectively. Locking or fixation means 9 and 9' are fixation pins which are pivotable within the cup-shaped bodies 6 and 8 in the respective articulated joints. Articulated joint 11 is shown without such a locking device to indicate an alternative, while locking device 10 is positioned in articulated arm 41.

When respective sides and top and base of the cabinet body are brought into the position as shown with reference numeral 5 or as indicated in FIG. 4, the fixation pins will be turned 90° with the aid of a screwdriver, which rotation will, in articulated joints 6 and 8, bring the fixation pins means into abutment with a shoulder or ledge 6" on the arm 6' of the articulated joint 6 or the corresponding parts 8" and 8' in articulated joint 8. For the articulated joint 7, fixation locking means 10 engage with a notch or ledge 7" in an extra wall section 7' in the cup-shaped body 7.

In this manner the fixation means will clamp and lock the arm of the articulated joint so that it cannot be moved in any direction. To provide a solution as outlined in FIGS. 1–4, it is necessary to have diagonally placed, outward-swinging articulated arms for lifting, with opposing articulated arms being diagonally pivotable inwards, where the four joint centers at all times retain the same mutual spacing and provide a parallel, two-layer package in collapsed state. The very special and inventive feature is that the construction enables installation between a floor 12 and ceiling 13 without a floor base. This is due to the fact that the body structure swings up in the form of a parallelogram from a packed state into functional position, where it is locked and may be moved into a space where there is little clearance to the floor and ceiling. This means that this type of body utilizes to the maximum the space between the floor and ceiling. Moreover, the edge joining method is rapid and simple, even for persons without any experience whatsoever.

As seen in FIGS. 2–4, arms 41 and 43 cooperating with cup-shaped members 7 and 11, respectively, have a stepped, straight and an L-shaped form, respectively. Either form could be used, dependent on to what degree the respective articulation means is to be visible from the cabinet interior. Further, arms 6' and 8' which cooperate with cup-shaped members 6 and 8, respectively, are generally U-shaped and L-shaped, respectively, dependent on to what extent the respective articulation means is to be seen from the cabinet interior. Thus, as will be appreciated from viewing FIG. 4 in particular, the articulation means located at the corners of the cabinet are in the erected or upright state of the cabinet body only partly visible from the cabinet interior, are flush with inwardly facing sides of the body panels, and are furthermore not visible from the outside of said body.

Figure 16:
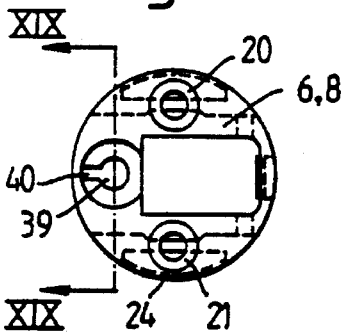
FIG. 16 shows the cup-shaped body seen from above.
Figure 17:
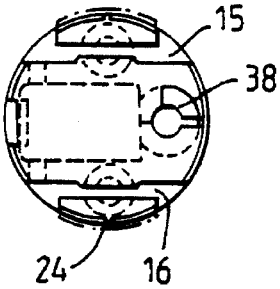
FIG. 17 illiterates the cup-shaped body seen from beneath.
Figure 18:
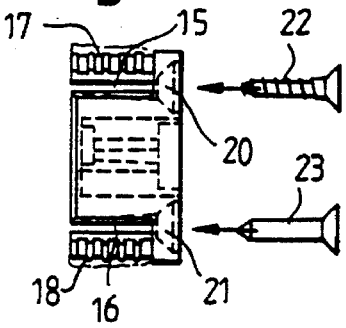
FIG. 18 illustrates the cup-shaped member seen from the side and with alternative expansion producing members.
Figure 19:
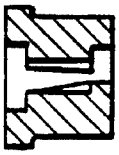
FIG. 19 shows the section XIX—XIX in FIG. 16.

To attach the fitting, e.g., to the side of a cabinet, one normally applies screws directly into the underlying material. If the fittings are to be flush mounted or recessed, this always entails drilling or milling operations in steps areas so that the screw will have some material to grip into. Alternatively, the part of the fitting where the screw is situated would be on the outside. The other existing method involves a cylindrical body having exterior hollow-like knurls which is pressed down into a drilled hole. The disadvantage of these known solutions is that the parts cannot be disassembled without damaging the surrounding material. The present invention requires no recess work for flush mounted fastening. As is apparent from FIGS. 16–18, there is no need for recess treatment to insert the fittings. Mounting of the cup-shaped body is done by inserting the body in the hole 14 (see FIG. 14*a*) drilled to fit the diameter of said body. It should be noted that the cup-shaped body is not to be pressed into the hole, but is merely guided in. As will be apparent from FIG. 18, and also from FIGS. 16 and 17, the cup-shaped body has two slots 15, 16 serving to form two sectors of the cup-shaped body parallel to each such slot. These sectors are numbered 17 and 18, respectively, and are each provided with grooves on the outward facing side. The reversible or dismountable anchoring takes place when the parts of the sides of the cup-shaped body that are provided with grooves or flutes are caused to expand against the wall of the recess 14. Parts 17, 18 thereby grip into the surrounding material formed by said wall 14 in structural part 19 and securely lock the cup-shaped body in place. In connection with said slots are provided holes 20, 21, preferably conical in shape, i.e., gradually decreasing in width toward the bottom of the cup. Into said holes 20, 21 are inserted expansion producing members 22 or 23, e.g., a screw 22 or a rotatable pin 23. Expansion is brought about when said screw or pin, generally designated as a cylindrical medium, is rotated or inserted down into the undercut recess or bore, thereby exerting force on said expanding parts. For disassembly, the cylindrical medium is removed, whereby the grip is released.

Figure 15:
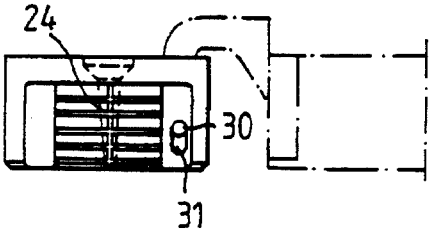
FIG. 15 shows a variant of the embodiment form in FIGS. 5–7 and 10 where the arm has an approximately U-shape.

Here it should be pointed out that in both the inward- and outward-swinging corner joints the female body is secured by means of the side of the body, as described immediately above. The articulated joint 11 in FIGS. 2–4, however, represents an exception to this. To ensure that the cup-shaped member shall not rotate within the bore hole, there is provided a crossing flange on said grooves or flutes, in FIGS. 15–17 denoted by reference numeral 24.

Figure 13:
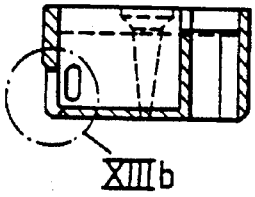
FIG. 13*a* shows a cup-shaped body of the articulated joint in FIGS. 5–7 and 10.
FIG. 13*b* shows the section XIIIb in FIG. 13*a*.
Figure 13:
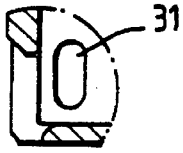
Figure 14:
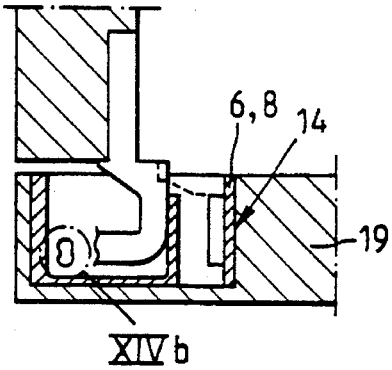
FIG. 14*a* shows a variant of the cup-shaped member in FIG. 13*a*.
FIG. 14*b* shows the section XIVb in FIG. 14*a*.
Figure 14:
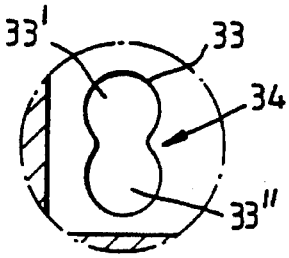

To enable the cabinet/furniture side to move past the corner denoted with reference numeral 25 in FIG. 3, the outward-swinging articulated arm 8' must also be movable in the direction of depth. For this purpose the cup-shaped body has a recess 26 where the projection 27 on the articulated arm is steered against two oblique planes or chamfers 28 and 29, together with rotating shaft 30 and its bearing slot 31. The movement of the arm is steered out and in by means of the lever-arm principle. The configuration of projection 27 causes rotating shaft 30 to be retained in its position until hook-like part 32 takes hold of plane 28 and lifts the arm (with the aid of rotating shaft 30 in hole/slot 31), causing the cabinet edge 3' to abut in, under pressure, against the cabinet/furniture side. Together with locking device 9, 11, which is brought into abutting contact with shoulder or ledge 6", 8" on articulated arm 6', 8', a two-point attachment is attained. If the furniture body is to be dismounted again, chamfer 29 acts on said projection lower part so as to lift rotating shaft 30 in hole 31 in the opposite direction, whereby the curve of projection 27 moves in tangential contact across the bottom of the cup-shaped body's interior. The result of this combined function is that it permits the arm, despite its movement in the oval hole, to shift its center without axial play (slippage). A variant of the requisite principle of shifting the center of the rotating shaft is also found on FIG. 14. Instead of the projection lever-arm movement, the oval slot has been given the form of a peanut shell, i.e., an oval hole having a central narrowing. This hole is shown in enlargement in FIG. **4*b*. As mentioned, hole 33 has the shape of a peanut shell contour, i.e., the opening is oblong with a narrowing 34 at its center section. This causes rotating shaft 30 to be held in place furthest out, i.e., in the uppermost part 33' of the hole or bearing slot 33. The upper section is indicated in FIG. 14*b* by reference numeral 33'. Similarly, the lower section of slot or hole 33 is indicated with reference numeral 33". It is common to both embodiments as shown, respectively, in FIGS. 13 and 14', that the locking or fixation means 9, 9', 10 has a locking flange 35 with a chamfer 36, which on being turned causes the flange 35 to slide into recess 6", 8" for the articulated arm. The articulated arm is thereby pressed downward. On the variant shown in FIG. 14, rotating shaft 30 will then be forced past the narrowing 34, and will end up in the lowermost or Innermost part of groove 33, denoted by reference numeral 33". Locking or fixation means 9, 9', 10 are rotated with the aid of a screwdriver which engages with a slot 36, optionally a cross-slot, therein. As a counter-hold the locking means has a perpendicular projection 37 that moves into a contiguous recess 38 (see FIG. 17). The rotational movement of the locking device is thereby limited to 90°. The locking or fixation means 9, 9', 10 are each guided down through a bore 39 in the cup-shaped member, where said bore has an milled groove 40 conforming to the dimension of said projection 37. There is preferably a tight fit between bores 39, 40 and locking or fixation means 9, 9', 10. As an alternative to locking or fixation means 9, 9', 10**, a stop screw may be used in a preferred embodiment.

The design of the cup-shaped member with the bearing slot and rotating shaft for the articulated arm makes it possible to create free passage at the critical point 25, as shown in FIG. 3 and FIGS. 5, 6 and 10.

As will be apparent from FIG. 4, the stepped straight arm may be fastened with the aid of screws 42 to the side 2 of the cabinet/furniture body. In a similar manner, arm 43 in connection with articulated joint 11 may be secured with screws 44 to the cabinet body side 3. Articulated arm 8' is attached to the body 3 with screws 45. Similarly, articulated arm 6' is fastened to the body's wall 3 with the aid of screws 48.

We claim:

1. A cabinet body structure having articulated joint means for joining adjacent end sections of structural parts of said cabinet body for enabling showing and mounting of such cabinet body; said body structure comprising first and second side panels, a top panel and a base panel, adjacent end sections of said side, top and base panels being provided with said articulation joint means to join adjacent panels together, thereby enabling movement of said first and second side panels, together with said top panel and base panel from a storage position and in mutually parallel relationship until said side panels are vertical, and fixing said body in an erected position, wherein said articulation joint means include a first type of articulation device located at internal corners of the cabinet and being subjected to an increase in included angle upon erection of the cabinet body, said first type device comprising a first cup-shaped member being pivotably connected at an uppermost open section thereof to a first arm, said first arm being provided with a first rotatable fixation pin adapted for engagement with a first ledge on said member for interlocking said member and said arm, and a second type of articulation device to be located at internal corners and being subjected to a decrease in included angle upon erection of the cabinet body, said second type device comprising a second cup-shaped member and a second arm with ends of a pivot shaft thereof each movable in an oblong bearing slot in said member as said second arm moves between its outer positions, said second arm being provided with a second ledge adapted for engagement with a second fixation pin rotatably mounted in said second member for interlocking said arm with said member.

2. A cabinet body structure having articulation joint means for joining adjacent end sections of structural parts of said cabinet body for enabling storing and mounting of such cabinet body, said body structure comprising first and second side panels, a top panel and a base panel, adjacent end sections of said side, top and base panels being provided with said articulation joint means to join adjacent panels together, thereby enabling movement of said side panels, together with said top panel and base panel from a storage position and in mutually parallel relationship until said side panels are vertical, and fixing said body in an erected position, wherein said means having a cup-shaped member and an arm with ends of a pivot shaft thereof each movable in an oblong bearing slot in said member as said arm moves between its outer positions, and said arm being provided with a ledge adapted for engagement with a fixation pin rotatably mounted in said member for interlocking said arm with said member.

3. Articulated joint means having a cup-shaped member and an arm with ends of a pivot shaft thereof each movable in an oblong bearing slot in said member as said arm moves between its outer positions, wherein said oblong bearing slot has its longitudinal axis parallel to an inside wall of the cup-shaped member, said oblong bearing slot having the contour of a peanut shell, a greatest width of the bearing slot corresponding to a diameter of the arm pivot shaft and a narrowest width being slightly smaller than the diameter of the arm pivot shaft for creating a snap function, said arm being provided with a ledge adapted for engagement with a fixation pin rotatably mounted in said member for interlocking said arm with said member and the fixation pin being configured such that on its rotation as it bears against said ledge, it gradually brings the arm pivot shaft down from an upper part of the bearing slot via a part of the slot having said narrowest width and to a lower part thereof.

4. Articulation joint means having a cup-shaped member and ends of an arm pivot shaft each movable in an oblong bearing slot in said member as said arm moves between its outer positions, said oblong bearing slot having its longitudinal axis parallel to an inside wall of the cup-shaped member, said arm being one of substantially L- and U-shaped, said arm when fully seated in said cup-shaped member having one branch of said arm parallel to and abutting the inside wall of said member to enhance locking of said arm, said arm being provided with a ledge adapted for engagement with a fixation pin rotatably mounted in said member for interlocking said arm with said member, and said arm being extended past the pivot shaft with a first hook-like section which engages with an upper edge of an opening in the wall of the cup-shaped member, and which upon rotation of the arm within the cup-shaped member, forces the pivot shaft to move from an upper position in the bearing slot to a lower position therein, and a second hook-like section that engages with a lower edge of said opening and on rotation of the arm out of the cup-shaped member, causes the pivot shaft to move from the lower position to the upper position in the bearing slot.

5. A cabinet body structure according to claim 1 wherein said oblong bearing slot has its longitudinal axis parallel to the rotation axis of said second fixation pin located in said cup-shaped member.

6. A cabinet body structure according to claim 1 wherein said second arm is one of substantially L- and U-shaped, said arm when fully seated in said cup-shaped member having one branch of said arm parallel to and abutting an inside wall of said member to enhance locking of said arm.

7. A body for a piece of furniture, said body having first and second side panels, a top panel and a base panel, adjacent end sections of said side, top and base panels being provided with articulation means for joining adjacent panels together and moving said first and second side panels together with said top panel and base panel from a storage position and a mutually parallel relationship until said side panels are vertical, said articulation means each having a cup-shaped member fitting into a respective recess in said top and base panels and an arm fitting into a respective recess in an adjacent one of said side panels, each said articulation means having means for releasably interlocking said arm and said member thereof from an inside space of the body when in its erected position, and said articulation means in said erected or upright state of said body being partly visible from the inside of said body and flush with inwardly facing sides of said panels, and invisible from an outside of said body.

8. A cabinet body structure according to claim 2 wherein said oblong bearing slot has its longitudinal axis parallel to the rotation axis of the fixation pin located in the cup-shaped member.

9. A cabinet body structure according to claim 2 wherein said arm being one of substantially L- and U-shaped, said arm when fully seated in said cup-shaped member having one branch of said arm parallel to and abutting an inside wall of said member to enhance locking of said arm.

10. Articulated joint means according to claim 3 wherein said oblong bearing slot has its longitudinal axis parallel to the rotation axis of the fixation pin located in the cup-shaped member.

11. Articulated joint means according to claim 3 wherein said arm being one of substantially L- and U-shaped, said arm when fully seated in said cup-shaped member having one branch of said arm parallel to and abutting an inside wall of said member to enhance locking of said arm.

12. Articulated joint means according to claim 4 wherein said oblong bearing slot has its longitudinal axis parallel to the rotation axis of the fixation pin located in the cup-shaped member.

13. Articulation joint means comprising a cup-shaped member including an oblong bearing slot and an arm with ends of a pivot shaft thereof each movable in the oblong bearing slot in said member as said arm moves between its outer positions, and said arm being provided with a ledge adapted for engagement with a fixation pin rotatably mounted in said member for interlocking said arm with said member.

14. Articulation joint means according to claim 13 wherein said oblong bearing slot has its longitudinal axis parallel to the rotation axis of the fixation pin located in the cup-shaped member.

15. Articulation joint means according to claim 13 wherein said arm being one of substantially L- and U-shaped, said arm when fully seated in said cup-shaped member having one branch of said arm parallel to and abutting an inside wall of said member to enhance locking of said arm.

* * * * *

UNITED STATES PATENT AND TRADEMARK OFFICE

CERTIFICATE OF CORRECTION

PATENT NO. : 5,468,061

DATED : November 21, 1995

INVENTOR(S) : Bror Fries, Yusho Nakamoto

It is certified that error appears in the above-indentified patent and that said Letters Patent is hereby corrected as shown below:

On the title page, please insert after "[21] Appl. No. 211,976" the following:

--[22] PCT Filed: October 21, 1992

[86] PCT No.: PCT/NO92/00177

§ 371 Date: June 21, 1994

§ 102(e) Date: June 21, 1994

[87] PCT Pub. No.: WO/93/07780

PCT Pub. Date: April 29, 1993--

Please delete "[22] Filed: Jun. 21, 1994"

Signed and Sealed this

Fourteenth Day of May, 1996

*Attest:*

Bruce Lehman

BRUCE LEHMAN

*Attesting Officer*

*Commissioner of Patents and Trademarks*